US011958518B2

(12) United States Patent
Gao et al.

(10) Patent No.: US 11,958,518 B2
(45) Date of Patent: Apr. 16, 2024

(54) METHOD AND DEVICE FOR CONTROLLING TRAIN FORMATION TRACKING

(71) Applicant: Traffic Control Technology Co., Ltd., Beijing (CN)

(72) Inventors: Chunhai Gao, Beijing (CN); Chao Liu, Beijing (CN); Feng Bao, Beijing (CN); Chunyu Zhang, Beijing (CN); Ziyu Wu, Beijing (CN)

(73) Assignee: Traffic Control Technology Co., Ltd. (CN)

( * ) Notice: Subject to any disclaimer, the term of this patent is extended or adjusted under 35 U.S.C. 154(b) by 374 days.

(21) Appl. No.: 17/156,116

(22) Filed: Jan. 22, 2021

(65) Prior Publication Data

US 2021/0403063 A1 Dec. 30, 2021

(30) Foreign Application Priority Data

Jun. 29, 2020 (CN) ..... 202010608574.2

(51) Int. Cl.
*B61L 27/16* (2022.01)
*B61L 23/04* (2006.01)
(Continued)

(52) U.S. Cl.
CPC ..... *B61L 27/16* (2022.01); *B61L 23/041* (2013.01); *B61L 23/18* (2013.01); *B61L 23/34* (2013.01);
(Continued)

(58) Field of Classification Search
CPC .... B61L 25/021; B61L 15/0072; B61L 3/008; B60T 7/22
See application file for complete search history.

(56) References Cited

U.S. PATENT DOCUMENTS

2004/0026575 A1 2/2004 Mindel
2004/0085197 A1* 5/2004 Watanabe ..... B60W 40/064 701/96
(Continued)

FOREIGN PATENT DOCUMENTS

CN 101480962 A 7/2009
CN 108765926 A 11/2018
(Continued)

OTHER PUBLICATIONS

Extended European Search Report, EP Application No. 21150401.4, dated Jun. 22, 2021, 8 pages, EPO.
(Continued)

*Primary Examiner* — S. Joseph Morano
*Assistant Examiner* — James William Jones
(74) *Attorney, Agent, or Firm* — Jaffery Watson Mendonsa & Hamilton LLP

(57) ABSTRACT

Embodiments of the present application provide a method and a device for controlling train formation tracking, the method comprising: obtaining a current distance between a first train and a second train in a train formation, wherein the first train is adjacent to the second train and located behind the second train; determining a target tracking mode of the first train based on the current distance, wherein the target tracking mode is one of a speed tracking mode, a distance tracking mode and a braking mode; and tracking the second train, by the first train based on the target tracking mode. Tracking efficiency is improved according to the method of the embodiments of the present application.

18 Claims, 1 Drawing Sheet

(51) Int. Cl.

| | |
|---|---|
| ***B61L 23/18*** | (2006.01) |
| ***B61L 23/34*** | (2006.01) |
| ***B61L 25/02*** | (2006.01) |
| ***B61L 27/04*** | (2006.01) |
| ***B61L 27/14*** | (2022.01) |
| ***B61L 27/20*** | (2022.01) |
| *B61L 15/00* | (2006.01) |

(52) U.S. Cl.
CPC ..... *B61L 25/021* (2013.01); *B61L 27/04* (2013.01); *B61L 27/14* (2022.01); *B61L 27/20* (2022.01); *B61L 15/0072* (2013.01)

(56) References Cited

U.S. PATENT DOCUMENTS

| | | | | |
|---|---|---|---|---|
| 2005/0090981 | A1* | 4/2005 | Gaegauf | B61L 27/04 701/1 |
| 2011/0046827 | A1* | 2/2011 | Yoon | B61L 3/008 701/20 |
| 2011/0184596 | A1* | 7/2011 | Andreasson | G08G 1/22 701/19 |
| 2015/0060608 | A1* | 3/2015 | Carlson | B61L 25/021 246/122 R |
| 2018/0194376 | A1* | 7/2018 | Draheim | B61L 15/009 |
| 2019/0161101 | A1* | 5/2019 | Brooks | B61L 25/025 |
| 2020/0262300 | A1* | 8/2020 | Tokumaru | B60L 15/40 |
| 2021/0086739 | A1* | 3/2021 | Fischer | B60L 15/2009 |

FOREIGN PATENT DOCUMENTS

| | | | | | |
|---|---|---|---|---|---|
| CN | 108973999 | A | | 12/2018 | |
| CN | 110588723 | A | * | 12/2019 | |
| CN | 110588723 | A | | 12/2019 | |
| CN | 110775098 | A | | 2/2020 | |
| CN | 111231957 | A | | 6/2020 | |
| CN | 112124370 | A | * | 12/2020 | B61H 11/14 |
| DE | 102018218368 | B3 | * | 12/2019 | |
| DE | 102018218368 | B3 | | 12/2019 | |
| EP | 3760513 | A1 | * | 1/2021 | B61L 15/0027 |
| IN | 110979401 | A | | 4/2020 | |
| KR | 20140028222 | A | * | 3/2014 | |
| WO | 2019227674 | A1 | | 12/2019 | |

OTHER PUBLICATIONS

First Office Action, CN Application No. 202010608574, dated Oct. 25, 2021, 18 pages including English Translation, SIPO.
Search Report, CN Application No. 202010608574, dated Oct. 15, 2021, 3 pages, SIPO.

* cited by examiner

METHOD AND DEVICE FOR CONTROLLING TRAIN FORMATION TRACKING

CROSS-REFERENCE TO RELATED APPLICATION

The present application claims priority to Chinese Application No. 2020106085742 filed on Jun. 29, 2020, entitled "Method and Device for Controlling Train Formation Tracking," which is hereby incorporated by reference in its entirety.

FIELD OF TECHNOLOGY

The present application relates to the technical field of train operation, and more particularly, to a method and a device for controlling train formation tracking.

BACKGROUND

Train formation tracking operation mode refers to a mode in which multiple trains run coordinately at the same speed with minimal intervals by wireless communication, instead of relying on physical connections. The purpose of train formation tracking operation control mode is to provide stable and coordinated operation of the train formation by controlling each train in the train group to run immediately after a preceding train, so as to provide safe and efficient operation of the train formation. In addition, through the formation tracking operation control, any two trains in the train formation have consistent speeds relatively, and the distance between two adjacent trains is the ideal distance under the premise that the train's mechanical performance and operating environment. When two trains have the same speeds relatively, these trains remain relatively stationary, thus the distance between trains can be reduced to some extent while ensuring safety. When the two trains are running at an ideal distance, the efficient operation of the trains can be guaranteed without collisions and other unsafety issues.

Traditional train formation tracking control modes mostly use multi-agent consistency control method to control the operation of the following trains in the formation, so that the following trains are as consistent as possible with the state of the preceding trains. However, the transition time of the formation from unstable to stable cannot be controlled, and the tracking efficiency cannot be guaranteed through the multi-agent consistent control method.

SUMMARY

Embodiments of the present application provide a method and a device for controlling train formation tracking, so as to improve the tracking efficiency of following trains in a train formation.

An embodiment of the present application provides a method for controlling train formation tracking, including:

obtaining a current distance between a first train and a second train in a train formation, wherein the first train is adjacent to the second train and located behind the second train;

determining a target tracking mode of the first train based on the current distance, wherein the target tracking mode is one of a speed tracking mode, a distance tracking mode and a braking mode; wherein the speed tracking mode is a mode in which a maximum safe speed of the first train is tracked as a control target, the distance tracking mode is a mode in which an ideal distance between the first train and the second train is tracked as a control target, and the braking mode is a mode in which a braking is applied at a maximum braking rate of the first train; and tracking the second train, by the first train, based on the target tracking mode.

In an embodiment, the obtaining a current distance between a first train and a second train in a train formation includes:

measuring the current distance between the first train and the second train in real time by a lidar sensor mounted on the first train.

In an embodiment, the determining a target tracking mode of the first train based on the current distance includes:

determining the target tracking mode of the first train as the speed tracking mode when the current distance is greater than a first preset threshold;

determining the target tracking mode of the first train as the distance tracking mode when the current distance is greater than a second preset threshold and less than the first preset threshold; and determining the target tracking mode of the first train as the braking mode when the current distance is less than the second preset threshold.

In an embodiment, before the determining the target tracking mode of the first train based on the current distance, the method further includes:

calculating the first preset threshold by the following equation:

$$D_1=\tau\times d_0;$$

calculating the second preset threshold by the following equation:

$$D_2=D_R+L+D_F;$$

where $D_1$ represents the first preset threshold, $D_2$ represents the second preset threshold, $\tau$ represents a preset mode switching coefficient, $d_0$ represents the ideal distance, $D_R$ represents a braking distance required for the first train from triggering emergency braking to stopping the train in the most unfavorable case, $D_F$ represents a braking distance required for the second train from triggering emergency braking to stopping the train in the most favorable case, and L represents a safety margin reserved between the first train and the second train.

In an embodiment, the tracking the second train, by the first train, based on the target tracking mode includes:

determining an expected acceleration of the first train based on the target tracking mode;

converting the expected acceleration into a traction-braking state and a traction-braking level of the first train based on a preset train traction-braking characteristic curve corresponding to the first train;

tracking the second train based on the traction-braking state and the traction-braking level of the first train.

In an embodiment, the determining an expected acceleration of the first train based on the target tracking mode includes:

calculating a speed error between a current speed and a target speed of the first train, and obtaining a first expected acceleration according to the speed error when the target tracking mode is the speed tracking mode, wherein the target speed is a maximum safe speed of the first train on a running line;

calculating a distance error between the current distance and a target distance, and obtaining a second expected acceleration according to the distance error when the target tracking mode is the distance tracking mode, wherein the target distance is an ideal distance between the first train and the second train; and determining a maximum braking acceleration of the first train as a third expected acceleration when the target tracking mode is the braking mode;

wherein the expected acceleration is the first expected acceleration, the second expected acceleration, or the third expected acceleration.

In an embodiment, the calculating a speed error between a current speed of the first train and a target speed includes: obtaining the current speed of the first train by a speed sensor mounted on the first train; and calculating a difference between the target speed and the current speed, and determining the difference as the speed error.

An embodiment further provides a device for controlling train formation tracking, including:

a measurement sensor, configured to obtain a current distance between a first train and a second train in a train formation by a lidar sensor, wherein the first train is adjacent to the second train and located behind the second train;

a decision determiner, configured to determine a target tracking mode of the first train based on the current distance, wherein the target tracking mode is one of a speed tracking mode, a distance tracking mode and a braking mode; the speed tracking mode is a mode in which a maximum safe speed of the first train is tracked as a control target through a speed tracking controller, the distance tracking mode is a mode in which an ideal distance between the first train and the second train is tracked as a control target through a distance tracking controller, and the braking mode is a mode in which a braking is applied at a maximum braking rate of the first train through a brake; and a low-level controller, configured to track the second train based on the target tracking mode.

As for the method and device for controlling train formation tracking according to the embodiments of the present application, the target tracking mode of the first train is determined based on the obtained current distance between the first train and the second train in the train formation, wherein the target tracking mode is one of a speed tracking mode, a distance tracking mode and a braking mode; wherein the speed tracking mode is a mode in which a maximum safe speed of the first train is tracked as a control target, the distance tracking mode is a mode in which an ideal distance between the first train and the second train is tracked as a control target, and the braking mode is a mode in which a braking is applied at a maximum braking rate of the first train; thereafter, the second train can be tracked based on the target tracking mode. The tracking mode during the tracking of the following train is selected, which ensures that the following train in the formation can track the preceding train with higher efficiency without colliding therewith.

BRIEF DESCRIPTION OF THE DRAWINGS

In order to make the technical solutions in the embodiments of the present application or the related art clearer, drawings needed in the embodiments or the description of the related art is briefly introduced as follows. Obviously, the drawings in the following description are only some of the embodiments of the present application. For those of ordinary skill in the art, other drawings can be obtained based on these drawings without paying any creative effort.

DETAILED DESCRIPTION

In order to specify the objectives, technical solutions and advantages of the embodiments of the present application, the technical solutions in the embodiments of the present application will be described clearly and completely in conjunction with the accompanying drawings in the embodiments of the present application. Obviously, the embodiments described below are part of the embodiments of the present application, rather than all of the embodiments. Based on the embodiments in the present application, all other embodiments obtained by those of ordinary skill in the art without creative effort shall fall within the protection scope of the present application.

Figure 1:
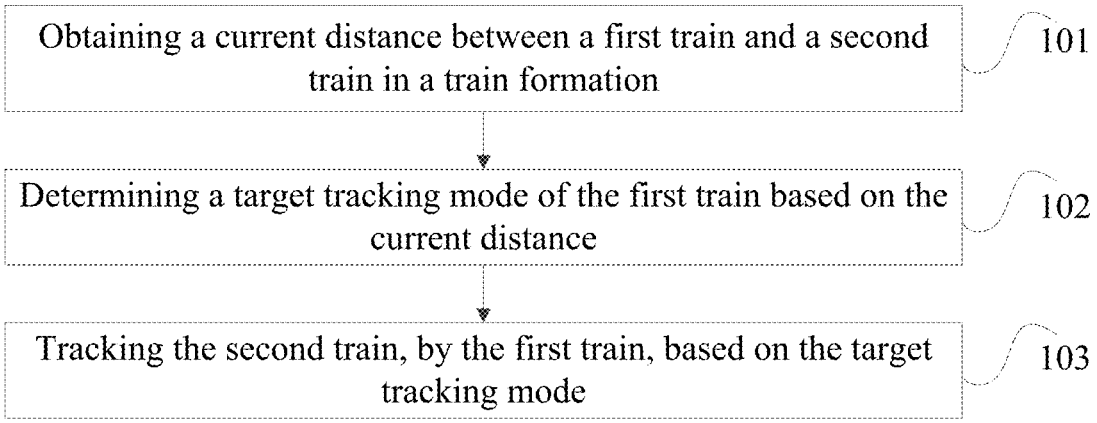
FIG. 1 is a flow chart of the steps of a method for controlling train formation tracking according to an embodiment of the present application.

FIG. 1 shows a flow chart of the steps of a method for controlling train formation tracking according to an embodiment of the present application, the method includes the following steps:

Step 101: obtaining a current distance between a first train and a second train in a train formation.

The first train and the second train are any two adjacent trains in a train formation, that is, the first train is adjacent to the second train and located behind the second train.

When performing tracking control between trains in a train formation, the first train may obtain the current distance between the first train and the second train in the train formation.

It should be noted that when the current distance between the first train and the second train in the train formation is obtained, the current distance between the first train and the second train can be measured in real time by the lidar sensor mounted on the first train.

Step 102: determining a target tracking mode of the first train based on the current distance.

The target tracking mode may be one of a speed tracking mode, a distance tracking mode and a braking mode; wherein the speed tracking mode is a mode in which a maximum safe speed of the first train is tracked as a control target, the distance tracking mode is a mode in which an ideal distance between the first train and the second train is tracked as a control target, and the braking mode is a mode in which a braking is applied at a maximum braking rate of the first train.

The ideal distance is an expected distance between the first train and the second train, which can be defined according to actual needs, and the specific value of the ideal distance is not defined herein.

In the speed tracking mode, the first train can track the second train at the maximum speed, quickly shorten the distance with the preceding train, and the distance between the two trains is reduced to a reasonable range. In the distance tracking mode, the purpose is to maintain a fixed ideal distance between the first train and the second train, so as to ensure that the distance between the trains can be adjusted to the ideal distance without triggering the emergency braking mode of the first train. In the braking mode, the first train brakes at the maximum braking rate, thereby avoiding a collision with the second train as the preceding train.

In this way, by providing the speed tracking mode, the distance tracking mode and the braking mode, and the target tracking mode of the first train is determined based on the current distance, the tracking efficiency of the first train is improved and the tracking time is shortened on the premise of ensuring no collision with the preceding train, thus enabling the following train in the train formation to reach a stable state of running at the ideal distance with the preceding train in the shortest time.

Step 103: tracking the second train, by the first train, based on the target tracking mode.

In this step, after the target tracking mode of the first train is determined, the first train directly tracks the second train based on the target tracking mode, so that the tracking efficiency of the first train is improved and the tracking time is shortened on the premise of ensuring no collision with the preceding train, thus enabling the following train in the train formation to reach a stable state of running at the ideal distance with the preceding train in the shortest time.

Further, in an embodiment, when determining the target tracking mode of the first train based on the current distance, the target tracking mode of the first train is determined to be the speed tracking mode when the current distance is greater than the first preset threshold; the target tracking mode of the first train is determined to be the distance tracking mode when the current distance is greater than the second preset threshold and less than the first preset threshold; and the target tracking mode of the first train is determined to be the braking mode when the current distance is less than the second preset threshold.

In this embodiment, the target tracking mode of the first train is determined based on the comparison result of the current distance with the first preset threshold and the second preset threshold, respectively. Firstly, it is determined whether the current distance is greater than the first preset threshold, if the current distance is greater than the first preset threshold, the target tracking mode is determined to be the speed tracking mode, so that when the first train is far away from the second train as the preceding train, the first train can track the preceding train at the maximum speed and quickly shorten the distance to the preceding train. When the current distance is not greater than the first preset threshold, it is determined whether the current distance is greater than the second preset threshold, when the current distance is greater than the second preset threshold, the target tracking mode is determined to be the distance tracking mode, thereby making it possible to adjust the distance between the two trains to the ideal distance without triggering the emergency braking mode. when the current distance is not greater than the second preset threshold, the target tracking mode of the first train is determined to be the braking mode, so that the first train is braked at the maximum braking rate, thereby avoiding a collision with the preceding train. In this way, the tracking control of the train formation during the transition period from unstable to stable is achieved and the tracking efficiency is improved through determining the target tracking modes above.

It should be noted that the first preset threshold and the second preset threshold can be calculated. That is, in this embodiment, before determining the target tracking mode of the first train based on the current distance, the first preset threshold and the second preset threshold may be calculated, namely:

the first preset threshold is calculated by the following equation:

$$D_1=\Sigma\times d_0;$$

the second preset threshold is calculated by the following equation:

$$D_2=D_R+L+D_F;$$

where $D_1$ represents the first preset threshold, $D_2$ represents the second preset threshold, $\tau$ represents a preset mode switching coefficient, $d_0$ represents the ideal distance, $D_R$ represents a braking distance required for the first train from triggering emergency braking to stopping the train in the most unfavorable case, $D_F$ represents a braking distance required for the second train from triggering emergency braking to stopping the train in the most favorable case, and L represents a safety margin reserved between the first train and the second train.

$\tau$ can be a reasonable value in the range of 1.2 to 2, which is not defined herein.

In addition, $D_R$ should be calculated in full consideration of various delay situation based on the description of the braking behavior of the train under the most unfavorable conditions in the IEEE 1474.1 standard. For the calculation of $D_F$, it should be considered that the train is in an ideal state with no delay at all, in which the braking is done instantaneously from the time it is triggered to the time it takes effect. Therefore, $D_R$ and $D_F$ can be calculated by the following equations based on the absolute speed of the first train and the absolute speed of the second train:

$$D_R = V_{R_EBI}t_1 + \frac{1}{2}a_{R_q}t_1^2 + (V_{R_EBI} + a_{R_q}t_1)t_2 + \frac{1}{2}a_{R_d}t_2^2 + \frac{(V_{R_EBI} + a_{R_q}t_1 + a_{R_d}t_2)^2}{2a_{R_Wbtake}}$$

$$t_1 = t_{R_ATP} + t_{R_q};$$

$$t_2 = t_{R_e} + t_{R_z};$$

$$D_F = \frac{V_{F_R_EBI}^2}{2a_{F_Bbrake}};$$

In the equations above, $t_{R_ATP}$ is ATP device response time of the first train, $t_{R_q}$ is traction clearing time of the first train, $t_{R_e}$ is extra time for emergency braking establishment of the first train, and $t_{R_z}$ is emergency braking establishment time of the first train; $V_{R_EBI}$ is a speed at which the emergency brake of the first train is triggered, and $V_{F_R_EBI}$ is a speed of the second train when the emergency brake of the first train is triggered; $a_{R_q}$ is a maximum traction acceleration of the first train, $a_{R_d}$ is a maximum idle acceleration of the first train, $a_{R_Wbtake}$ is an emergency braking deceleration of the first train in the most unfavorable case, and $a_{F_Bbrake}$ is an emergency braking deceleration of the second train in the most favorable case.

In this way, the first preset threshold is determined based on the ideal distance between the first train and the second train, and the second preset threshold is determined based on the braking distance required for the first train from triggering emergency braking to stopping the train in the most unfavorable case, the braking distance required for the second train from triggering emergency braking to stopping the train in the most favorable case and the reserved safety margin, so that the first preset threshold is greater than the ideal distance. Thus, when the current distance between the two trains is greater than the first preset threshold and the tracking is performed in the speed tracking mode, there is no need to worry about collisions between the two trains and the tracking efficiency can be improved. In addition, the second preset threshold is related to the braking distance, so that when the first train is tracking in the distance tracking mode, it can be ensured that the braking mode will not be triggered, thereby avoiding collisions with the preceding train.

Further, in an embodiment, when the second train is tracked based on the target tracking mode, the expected acceleration of the first train can be determined based on the target tracking mode; then, the expected acceleration is converted into a traction-braking state and a traction-braking level of the first train based on a preset train traction-braking characteristic curve corresponding to the first train; and the second train can be tracked based on the traction-braking state and the traction-braking level of the first train.

While the expected acceleration of the first train is determined based on the target tracking mode, a speed error between the current speed of the first train and the target speed can be calculated when the target tracking mode is the speed tracking mode, and the first expected acceleration is obtained according to the speed error, wherein the target speed is the maximum safe speed of the first train on a running line. A distance error between the current distance and the target distance is calculated, and a second expected acceleration is obtained according to the distance error when the target tracking mode is the distance tracking mode, wherein the target distance is an ideal distance between the first train and the second train; and a maximum braking acceleration of the first train is determined as a third expected acceleration when the target tracking mode is the braking mode; wherein the expected acceleration is the first expected acceleration, the second expected acceleration, or the third expected acceleration.

While the speed error between the current speed of the first train and the target speed is calculated, the current speed of the first train can be obtained by a speed sensor mounted on the first train, and then a difference between the target speed and the current speed is calculated, and the difference is determined as the speed error.

Since the current speed of the first train is obtained by the speed sensor, the accuracy of the obtained current speed is ensured.

Thus, in this embodiment, when the target tracking mode is the speed tracking mode, the first expected acceleration is obtained according to the speed error between the current speed of the first train and the target speed, and then is converted into the traction-braking state and the traction-braking level of the first train, and the second train is tracked based on the traction-braking state and the traction-braking level of the first train, thereby ensuring the tracking efficiency. When the target tracking mode is the distance tracking mode, the second expected acceleration is obtained according to the distance error between the current distance and the target distance, and the second expected acceleration is converted into the traction-braking state and the traction-braking level of the first train, and the second train is tracked based on the traction-braking state and the traction-braking level of the first train. When the target tracking mode is the braking mode, the maximum braking acceleration of the first train is directly determined as the third expected acceleration, and the third expected acceleration is converted into the traction-braking state and the traction-braking level of the first train, and the second train is tracked based on the traction-braking state and the traction-braking level of the first train, thereby avoiding collisions between the two trains.

The overall control process of according to an embodiment is described in detail below, and the overall control process includes the following steps:

Step 1: in a train formation, measuring the current distance between the first train and the second train which serves as the preceding train, the relative speed between the first train and the preceding train by a lidar sensor and a millimeter wave radar sensor, and measuring the absolute speed of the first train through the speed sensor in real time.

Step 2: calculating, by the first train, the absolute speed of the preceding train by a measurement sensor based on the absolute speed of first train and the relative speed between the first train and the preceding train (i.e., the second train), that is, the absolute speed of the preceding train is equal to the sum of the absolute speed of the first train and the relative speed between the first train and the preceding train.

Step 3: calculating the first preset threshold according to $D_1=\tau\times d_0$, wherein $\tau$ represents the preset mode switching coefficient, a reasonable value between 1.2 and 2, and do represents the ideal distance between the first train and the second train; and calculating the second preset threshold according to $D_2=D_R+L+D_F$, wherein $D_R$ represents the braking distance required for the first train from triggering emergency braking to stopping the train in the most unfavorable case, $D_F$ represents the braking distance required for the second train from triggering emergency braking to stopping the train in the most favorable case, and L represents the safety margin reserved between the first train and the second train.

Figure 2:
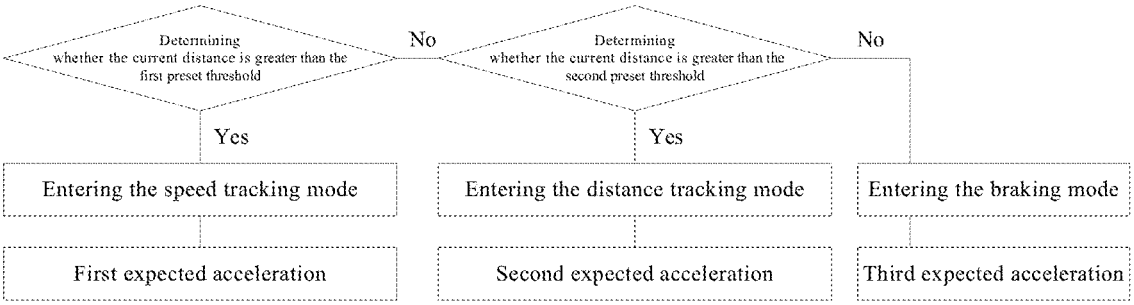
FIG. 2 is a schematic diagram of determining a target tracking mode in which a first train enters according to an embodiment of the present application.

Step 4: as shown in FIG. 2, judging using the measured current distance between the first train and the second train, the first preset threshold $D_1$, and the second predetermined threshold $D_2$ to determine a tracking mode that the first train should enter.

Wherein firstly it is determined whether the current distance is greater than the first preset threshold $D_1$, if the current distance is greater than the first preset threshold, then the speed tracking controller can be entered, namely, the speed tracking mode is entered. With the maximum safe speed of the line as the control target by the speed tracking controller, the speed error between the current speed of the first train and the target speed is calculated, and the first expected acceleration is calculated by the closed-loop error controller. If the current distance is not greater than the first preset threshold, it is determined whether the current distance is greater than the second preset threshold, if the current distance is greater than the second preset threshold, the distance tracking controller is entered, namely, the distance tracking mode is entered. With the ideal distance maintained with the preceding train as the control target by the distance tracking controller, the distance error between the current distance and the target distance is calculated, and the second expected acceleration is calculated by the closed-loop error controller. If the current distance is less than the second preset threshold, the braking mode is entered to directly output the maximum braking acceleration of the train as the third expected acceleration.

The design principles of the speed tracking controller are: the controllers include but not limited to PID controller, hysteresis comparators or sliding mode controllers, and achieving stability in the shortest time is taken as the design principle, so that the following train can quickly shorten the distance to the preceding train, thereby improving tracking efficiency. In addition, the design principles of the distance tracking controller are: the controllers include but not limited to PID controller, hysteresis comparators or sliding mode controllers, and no transient overshoot is taken as the design principle, so that the distance between the following train and the preceding train is kept greater than the minimum safe distance threshold that is the second preset threshold during the transient adjustment process of formation tracking, without triggering the braking mode.

In this way, through the multi-mode tracking of speed tracking mode, distance tracking mode and braking mode, the speed tracking mode can be entered when the distance between the two trains is far, which can quickly shorten the distance between the two trains. The distance tracking mode is entered when the distance between the two trains is close to the ideal distance, and the distance between this train and the preceding train is dynamically adjusted under the principle of not triggering emergency braking as much as possible, and finally this train and the preceding train are kept at the ideal distance. The emergency braking mode is entered when the distance between the two trains is less than the second preset threshold which is the minimum safe distance threshold, and the following train brakes at the maximum braking rate to avoid a collision with the preceding train.

Step 5: inputting the obtained expected acceleration to the low-level controller of this train, so that the low-level controller can convert the expected acceleration into the traction-braking state and the traction-braking level of the train by checking the traction-braking characteristic curve of train, thereby controlling the first train to complete the formation tracking operation.

So far, the tracking control between two adjacent trains in the train formation is completed, which ensures that the following train in the train formation can follow the preceding train with high efficiency without collisions with the preceding train.

Figure 3:
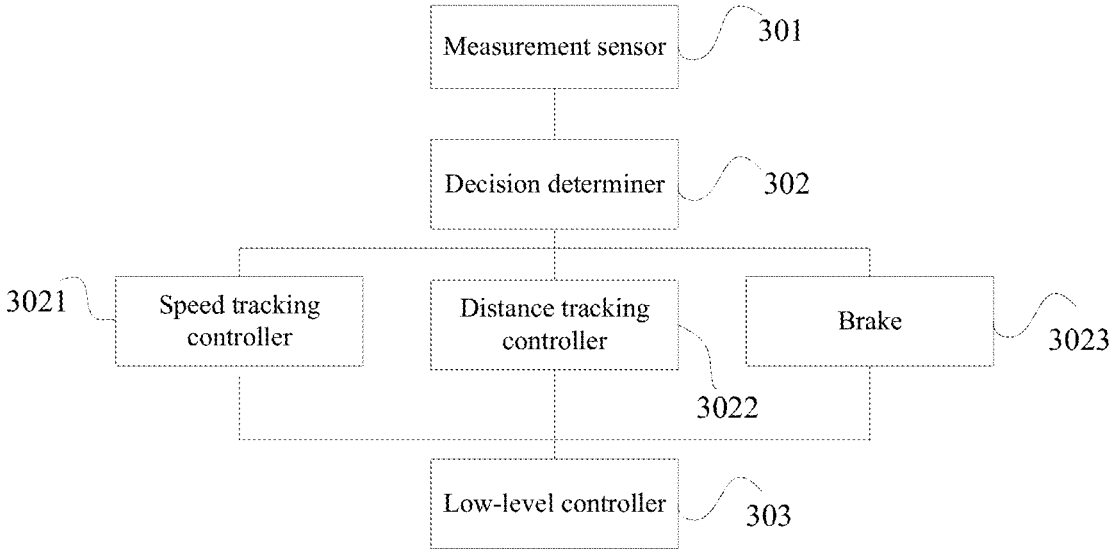
FIG. 3 is a block diagram of a device for controlling train formation tracking according to an embodiment of the present application.

In addition, FIG. 3 is a block diagram of a device for controlling train formation tracking according to an embodiment of the present application, the device including:

a measurement sensor 301, configured to obtain a current distance between a first train and a second train in a train formation through a lidar sensor, wherein the first train is adjacent to the second train and located behind the second train;

a decision determiner 302, configured to determine a target tracking mode of the first train based on the current distance, wherein the target tracking mode is one of a speed tracking mode, a distance tracking mode and a braking mode; the speed tracking mode is a mode in which a maximum safe speed of the first train is tracked as a control target through a speed tracking controller 3021, the distance tracking mode is a mode in which an ideal distance between the first train and the second train is tracked as a control target through a distance tracking controller 3022, and the braking mode is a mode in which a braking is applied at a maximum braking rate of the first train through a brake 3023; and a low-level controller 303, configured to track the second train based on the target tracking mode.

In an embodiment, the decision determiner 302 is configured to:

determine the target tracking mode of the first train as the speed tracking mode when the current distance is greater than a first preset threshold, and start the speed tracking controller 3021;

determine the target tracking mode of the first train as the distance tracking mode when the current distance is greater than a second preset threshold and less than the first preset threshold, and start the distance tracking controller 3022; and determine the target tracking mode of the first train as the braking mode when the current distance is less than the second preset threshold, and start the brake 3023.

It should be noted that the device can implement all the method steps that can be implemented in the foregoing method embodiments, and can achieve the same technical effect, which will not be repeated here.

In addition, an embodiment further provides an electronic device, including a memory, a processor, and a computer program stored in the memory and capable of being performed on the processor, wherein the steps of the method for controlling train formation tracking are implemented when the processor performs the program.

An embodiment of the present application provides a non-transitory computer-readable storage medium on which a computer program is stored, wherein the steps of the method for controlling train formation tracking are implemented when the computer program is performed by the processor.

The device embodiments described above are only schematic, wherein the units described as separate components may or may not be physically separated, and parts displayed as units may or may not be physical units, namely, they may be located in one place or, may be distributed to multiple network units. Some or all of the modules may be selected according to actual needs to achieve the purpose of the solution of this embodiment. It can be understood and implemented by a person of ordinary skill in the art without paying creative labor.

Through the description of the above embodiments, it can be clearly understood by those skilled in the art that each embodiment can be implemented by means of software plus a necessary general hardware platform, and of course, it can also be implemented by hardware. Based on this understanding, the essence or the part that contributes to the existing technology of the technical solutions mentioned above can be embodied in the form of software products, and the computer software products can be stored in computer readable storage media, such as ROM, RAM, magnetic disc, and compact disc. The software includes several instructions to enable a computer device (may be a personal computer, server, or network device, etc.) to perform the methods of various embodiments or some parts of the embodiments.

It should be noted that the embodiments are only for illustrating the technical solutions of the present application, rather than limiting them; although the present application has been described in detail with reference to the foregoing embodiments, those skilled in the art should understand that the technical solutions documented in the preceding embodiments may still be modified, or parts of the technical features thereof can be equivalently substituted; and such modifications or substitutions do not deviate from scope of the technical solutions of the embodiments of the present application.

The invention claimed is:

1. A method for controlling train formation tracking, comprising:

obtaining a current distance between a first train and a second train in a train formation by means of real-time measurement performed by a lidar sensor mounted on the first train, wherein the first train is adjacent to the second train and located behind the second train;

determining a target tracking mode of the first train based on the current distance between the first train and the second train in the train formation with the target tracking mode being selected from a speed tracking mode, a distance tracking mode and a braking mode; wherein the speed tracking mode is a mode in which a maximum safe speed of the first train with respect to the second train is tracked as a control target through a speed tracking controller, the distance tracking mode is a mode in which an ideal distance between the first train and the second train is tracked as a control target through a distance tracking controller without triggering the braking mode of the first train, and the braking mode is a mode in which a braking is applied at a maximum braking rate of the first train; and tracking the second train, by the first train based on the target tracking mode.

2. The method for controlling train formation tracking of claim 1, further comprising:

obtaining a relative speed between the first train and the second train by the lidar sensor and a radar sensor.

3. The method for controlling train formation tracking of claim 2, wherein the tracking of the second train, by the first train, based on the target tracking mode comprises:

determining an expected acceleration of the first train based on the target tracking mode;

converting the expected acceleration into a traction-braking state and a traction-braking level of the first train based on a preset train traction-braking characteristic curve corresponding to the first train;

tracking the second train based on the traction-braking state and the traction-braking level of the first train.

4. The method for controlling train formation tracking of claim 3, wherein the determining an expected acceleration of the first train based on the target tracking mode comprises:

calculating a speed error between a current speed and a target speed of the first train, and obtaining a first expected acceleration according to the speed error when the target tracking mode is the speed tracking mode, wherein the target speed is a maximum safe speed of the first train on a running line;

calculating a distance error between the current distance and a target distance, and obtaining a second expected acceleration according to the distance error when the target tracking mode is the distance tracking mode, wherein the target distance is an ideal distance between the first train and the second train; and determining a maximum braking acceleration of the first train as a third expected acceleration when the target tracking mode is the braking mode; wherein the expected acceleration is the first expected acceleration, the second expected acceleration, or the third expected acceleration.

5. The method for controlling train formation tracking of claim 4, wherein the calculating a speed error between a current speed of the first train and a target speed comprises: obtaining the current speed of the first train by a speed sensor mounted on the first train; and calculating a difference between the target speed and the current speed, and determining the difference as the speed error.

6. The method for controlling train formation tracking of claim 1, wherein the determining of a target tracking mode of the first train based on the current distance comprises:

determining the target tracking mode of the first train as the speed tracking mode when the current distance between the first train and the second train is greater than a first preset threshold;

determining the target tracking mode of the first train as the distance tracking mode when the current distance is greater than a second preset threshold and less than the first preset threshold; and determining the target tracking mode of the first train as the braking mode when the current distance is less than the second preset threshold.

7. The method for controlling train formation tracking of claim 6, further comprising:

calculating the first preset threshold by the following equation:

$$D_1=\tau\times d_0;$$

calculating the second preset threshold by the following equation:

$$D_2=D_R+L+D_F;$$

Where $D_1$ represents the first preset threshold, $D_2$ represents the second preset threshold, $\tau$ represents a preset mode switching coefficient, $d_0$ represents the ideal distance, $D_R$ represents a braking distance required for the first train from triggering emergency braking to stopping the train in the most unfavorable case, $D_F$ represents a braking distance required for the second train from triggering emergency braking to stopping the train in the most favorable case, and L represents a safety margin reserved between the first train and the second train.

8. The method for controlling train formation tracking of claim 7, wherein the tracking of the second train, by the first train, based on the target tracking mode comprises:

determining an expected acceleration of the first train based on the target tracking mode;

converting the expected acceleration into a traction-braking state and a traction-braking level of the first train based on a preset train traction-braking characteristic curve corresponding to the first train;

tracking the second train based on the traction-braking state and the traction-braking level of the first train.

9. The method for controlling train formation tracking of claim 8, wherein the determining an expected acceleration of the first train based on the target tracking mode comprises:

calculating a speed error between a current speed and a target speed of the first train, and obtaining a first expected acceleration according to the speed error when the target tracking mode is the speed tracking mode, wherein the target speed is a maximum safe speed of the first train on a running line;

calculating a distance error between the current distance and a target distance, and obtaining a second expected acceleration according to the distance error when the target tracking mode is the distance tracking mode, wherein the target distance is an ideal distance between the first train and the second train; and determining a maximum braking acceleration of the first train as a third expected acceleration when the target tracking mode is the braking mode; wherein the expected acceleration is the first expected acceleration, the second expected acceleration, or the third expected acceleration.

10. The method for controlling train formation tracking of claim 9, wherein the calculating a speed error between a current speed of the first train and a target speed comprises: obtaining the current speed of the first train by a speed sensor mounted on the first train; and calculating a difference between the target speed and the current speed, and determining the difference as the speed error.

11. The method for controlling train formation tracking of claim 6, wherein the tracking of the second train, by the first train, based on the target tracking mode comprises:

determining an expected acceleration of the first train based on the target tracking mode;

converting the expected acceleration into a traction-braking state and a traction-braking level of the first train based on a preset train traction-braking characteristic curve corresponding to the first train;

tracking the second train based on the traction-braking state and the traction-braking level of the first train.

12. The method for controlling train formation tracking of claim 11, wherein the determining an expected acceleration of the first train based on the target tracking mode comprises:

calculating a speed error between a current speed and a target speed of the first train, and obtaining a first expected acceleration according to the speed error when the target tracking mode is the speed tracking mode, wherein the target speed is a maximum safe speed of the first train on a running line;

calculating a distance error between the current distance and a target distance, and obtaining a second expected acceleration according to the distance error when the target tracking mode is the distance tracking mode, wherein the target distance is an ideal distance between the first train and the second train; and determining a maximum braking acceleration of the first train as a third expected acceleration when the target tracking mode is the braking mode; wherein the expected acceleration is the first expected acceleration, the second expected acceleration, or the third expected acceleration.

13. The method for controlling train formation tracking of claim 12, wherein the calculating a speed error between a current speed of the first train and a target speed comprises: obtaining the current speed of the first train by a speed sensor mounted on the first train; and calculating a difference between the target speed and the current speed, and determining the difference as the speed error.

14. The method for controlling train formation tracking of claim 1, wherein the tracking of the second train, by the first train, based on the target tracking mode comprises:

determining an expected acceleration of the first train based on the target tracking mode;

converting the expected acceleration into a traction-braking state and a traction-braking level of the first train based on a preset train traction-braking characteristic curve corresponding to the first train;

tracking the second train based on the traction-braking state and the traction-braking level of the first train.

15. The method for controlling train formation tracking of claim 14, wherein the determining an expected acceleration of the first train based on the target tracking mode comprises:

calculating a speed error between a current speed and a target speed of the first train, and obtaining a first expected acceleration according to the speed error when the target tracking mode is the speed tracking mode, wherein the target speed is a maximum safe speed of the first train on a running line;

calculating a distance error between the current distance and a target distance, and obtaining a second expected acceleration according to the distance error when the target tracking mode is the distance tracking mode, wherein the target distance is an ideal distance between the first train and the second train; and determining a maximum braking acceleration of the first train as a third expected acceleration when the target tracking mode is the braking mode;

wherein the expected acceleration is the first expected acceleration, the second expected acceleration, or the third expected acceleration.

16. The method for controlling train formation tracking of claim 15, wherein the calculating a speed error between a current speed of the first train and a target speed comprises: obtaining the current speed of the first train by a speed sensor mounted on the first train; and calculating a difference between the target speed and the current speed, and determining the difference as the speed error.

17. A device for controlling train formation tracking, comprising:

a measurement lidar sensor of a first train, configured to obtain a current distance between the first train and a second train in a train formation, wherein the first train is adjacent to the second train and located behind the second train;

a processor, configured to determine a target tracking mode of the first train based on the current distance between the first train and the second train in the train formation with the target tracking mode being selected from a speed tracking mode, a distance tracking mode and a braking mode; the speed tracking mode is a mode in which a maximum safe speed of the first train with respect to the second train is tracked as a control target through a speed tracking controller, the distance tracking mode is a mode in which an ideal distance between the first train and the second train is tracked as a control target through a distance tracking controller without triggering the braking mode of the first train, and the braking mode is a mode in which a braking is applied at a maximum braking rate of the first train through a brake; and a low-level controller, configured to track the second train based on the target tracking mode.

18. The device for controlling train formation tracking of claim 17, wherein the processor is configured to:

determine the target tracking mode of the first train as the speed tracking mode when the current distance is greater than a first preset threshold, and start the speed tracking controller;

determine the target tracking mode of the first train as the distance tracking mode when the current distance is greater than a second preset threshold and less than the first preset threshold, and start the distance tracking controller; and determine the target tracking mode of the first train as the braking mode when the current distance is less than the second preset threshold, and start the brake.

* * * * *